US007698785B2

(12) United States Patent
Bennett

(10) Patent No.: US 7,698,785 B2
(45) Date of Patent: Apr. 20, 2010

(54) ARTICULATING HINGE

(75) Inventor: Nicholas Paul Bennett, Redditch (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 12/141,738

(22) Filed: Jun. 18, 2008

(65) Prior Publication Data

US 2008/0256752 A1 Oct. 23, 2008

Related U.S. Application Data

(63) Continuation of application No. 11/067,875, filed on Feb. 28, 2005, now abandoned.

(60) Provisional application No. 60/548,356, filed on Feb. 28, 2004.

(51) Int. Cl.
*E05D 15/00* (2006.01)

(52) U.S. Cl. ..... 16/369; 16/368; 16/239; 16/286

(58) Field of Classification Search ..... 16/368, 16/369, 370, 287, 288, 239, 286, 366
See application file for complete search history.

(56) References Cited

U.S. PATENT DOCUMENTS

| | | | | | |
|---|---|---|---|---|---|
| 1,030,936 | A | * | 7/1912 | Soss | 16/369 |
| 1,269,403 | A | * | 6/1918 | Dianovszky | 16/369 |
| 1,280,357 | A | * | 10/1918 | Zuckerman | 16/369 |
| 1,810,508 | A | * | 6/1931 | Walter | 16/369 |
| 2,120,685 | A | | 6/1938 | Soss et al. | |
| 2,135,280 | A | * | 11/1938 | Erickson | 16/369 |
| 2,686,332 | A | * | 8/1954 | Moon et al. | 16/369 |
| 2,694,216 | A | * | 11/1954 | Schnur | 16/369 |
| 3,001,224 | A | * | 9/1961 | Soss | 16/276 |
| 3,351,975 | A | | 11/1967 | Goto | |
| 3,363,281 | A | | 1/1968 | Borsani | |
| 3,673,635 | A | * | 7/1972 | Cencioni | 16/358 |
| 4,470,169 | A | | 9/1984 | Lautenschlager et al. | |
| 4,736,491 | A | | 4/1988 | Mertes | |
| 4,799,289 | A | | 1/1989 | Grass | |
| 4,817,241 | A | * | 4/1989 | Koch et al. | 16/238 |
| 4,837,894 | A | | 6/1989 | Lin | |
| 4,881,297 | A | | 11/1989 | Grass | |
| 4,914,782 | A | | 4/1990 | Rupprechter | |
| 5,035,026 | A | | 7/1991 | Carlo et al. | |

(Continued)

FOREIGN PATENT DOCUMENTS

DE 31 29 606 A1 6/1982

(Continued)

OTHER PUBLICATIONS

Grass, Model G333 Classic Hinge, 2005.

(Continued)

*Primary Examiner*—Victor Batson
*Assistant Examiner*—Jeffrey O'Brien
(74) *Attorney, Agent, or Firm*—Paul & Paul

(57) ABSTRACT

An articulated hinge is provided which is capable of supporting a panel member and permitting the panel member to be moved away from an opening and at the same time permit the panel member to be rotated approximately 90 degrees. The hinge has a scissor arm mechanism which provides for smooth opening and closing of the hinge thereby eliminating a possible sticking of the hinge during opening.

11 Claims, 15 Drawing Sheets

U.S. PATENT DOCUMENTS

| | | | | |
|---|---|---|---|---|
| 5,058,238 | A | 10/1991 | Lautenschlager | |
| 5,062,182 | A | 11/1991 | Griffiths et al. | |
| 5,239,730 | A | 8/1993 | Grass | |
| 5,450,655 | A | 9/1995 | Ferrari et al. | |
| 5,471,709 | A * | 12/1995 | Lanzani | 16/238 |
| 6,141,832 | A | 11/2000 | Salice | |
| 6,243,918 | B1 | 6/2001 | Zetti | |
| 6,269,521 | B1 * | 8/2001 | Gabel | 16/287 |
| 6,308,376 | B1 | 10/2001 | Koshikawa | |
| 6,374,459 | B1 | 4/2002 | Zetti | |
| 6,402,270 | B1 * | 6/2002 | Frank | 312/138.1 |
| 6,499,189 | B2 * | 12/2002 | Kondo et al. | 16/289 |
| 6,568,035 | B2 | 5/2003 | Zetti | |
| 6,647,592 | B2 * | 11/2003 | Presley | 16/366 |
| 6,701,574 | B2 * | 3/2004 | Hashim et al. | 16/289 |
| 6,757,939 | B2 | 7/2004 | Mueller et al. | |
| 7,334,361 | B2 * | 2/2008 | Schrimpf et al. | 40/452 |
| 2001/0025398 | A1 * | 10/2001 | Zetti | 16/370 |

FOREIGN PATENT DOCUMENTS

| | | | |
|---|---|---|---|
| DE | 39 30 609 | A1 | 3/1991 |
| DE | 40 23 467 | A1 | 1/1992 |
| DE | 101 52 699 | A1 | 4/2003 |
| EP | 3323 | A1 * | 8/1979 |
| EP | 565900 | A1 * | 10/1993 |

OTHER PUBLICATIONS

Grass, Model G593 Butterfly Hinge, 2005.
Grass, Model G393 Classic Hinge, 2005.
Grass, Model G3903 Hinge, 2005.
Grass, Model G313 Classic Hinge, 2005.
Grass, Model G193 Eco Hinge, 2005.
Photograph of MiTAC Hinge, Feb. 2004, 3 pages.
Web Page, http://www.sugatsune.com/products/ProductDetails.cfm?CATID=7&SUBCATID=9&PRODUCTID=HT%2D16 , Sugatsune America, Inc., HT-160 Hinge, Sep. 27, 2004, 2 pages.
Web Page, http://www.dtc.en.alibaba.com/product/50003466/50028899/C93__on__Concealed__Hinge/showing.html , Shunde Huatai Metal Goods Ltd., C93 Clip-On Concealed Hinge, Sep. 27, 2004, 2 pages.
Web Page, http://www.blum.us/usa/en/03/02/04/index.jsp;jsessionid=0000L5QR-V2U0qP3__3cVC0vHPqt:-1 , Blum Inc., Modul Hinge System, Sep. 2, 2004, 4 pages.

* cited by examiner

ARTICULATING HINGE

CROSS REFERENCE TO RELATED APPLICATIONS

This application claims priority to U.S. non-provisional application Ser. No. 11/067,875 filed on Feb. 28, 2005, which claims priority to U.S. provisional patent application 60/548,356 entitled Articulating Hinge filed on Feb. 28, 2004, each application of which is hereby incorporated by reference herein.

BACKGROUND OF THE INVENTION

The present invention relates generally to hinges. Particularly, the invention relates to articulated hinges or hinges having joints.

Hinges are known in the art and are provided for the opening and closing of a member such as a door or panel.

SUMMARY OF THE INVENTION

In accordance with the present invention, it is an object to provide an improved hinge with a smooth opening and closing operation such that the hinge does not stick or bind during the opening or closing operation.

A further object of this invention is to provide such a hinge mechanism with structural components for ease of assembly, and reliable operations.

It is a second object of the present invention to provide a hinge which permits a deep or thick door or panel on an enclosure to open approximately 90 degrees when another door of the same depth is located directly below the first door or panel.

Another object of the present invention is to provide a hinge which has two fixed pivot points on a hinge body or base from which members of the hinge pivot.

The objects of the present invention are realized in a hinge having a scissors arm structure which permits rotation of the panel to occur at a distance away from the hinge body. This hinge has a scissor arm structure, which is suitable for operating a panel on an enclosure, or bin and the like.

The hinge has an elongate first member and an elongate second member which move relative to one another in the plane of their elongations thereby pivoting in a scissor-like operation. A spring attached at one end to the central pivot means of the first member and second member biases the first member relative to a support member which is pivotable at an end of the first member. A link member attached to an end of the second member is pivotable at one end relative to an end of a support member to implement an articulated motion between the first member and second member as they move relative to one another.

The hinge base or body has a base link member pivotable at a fixed point on the hinge base or body and the base link member is pivotable at one end relative to an end of the first member. One end of the second member is pivotable at a fixed point on the hinge base or body also.

The spring force is selected to match the door weight, and other factors which are considered.

When the hinge is extended from the closed position to an open position or an intermediate open position, the support member can support the weight of the panel and hold it in the open position.

BRIEF DESCRIPTION OF THE DRAWINGS

The features, advantages and operation of the present invention will become readily apparent and further understood from a reading of the following detailed description of the invention with the accompanying drawings, in which like numeral refer to like elements, in which.

DETAILED DESCRIPTION OF THE INVENTION

Figure 2:
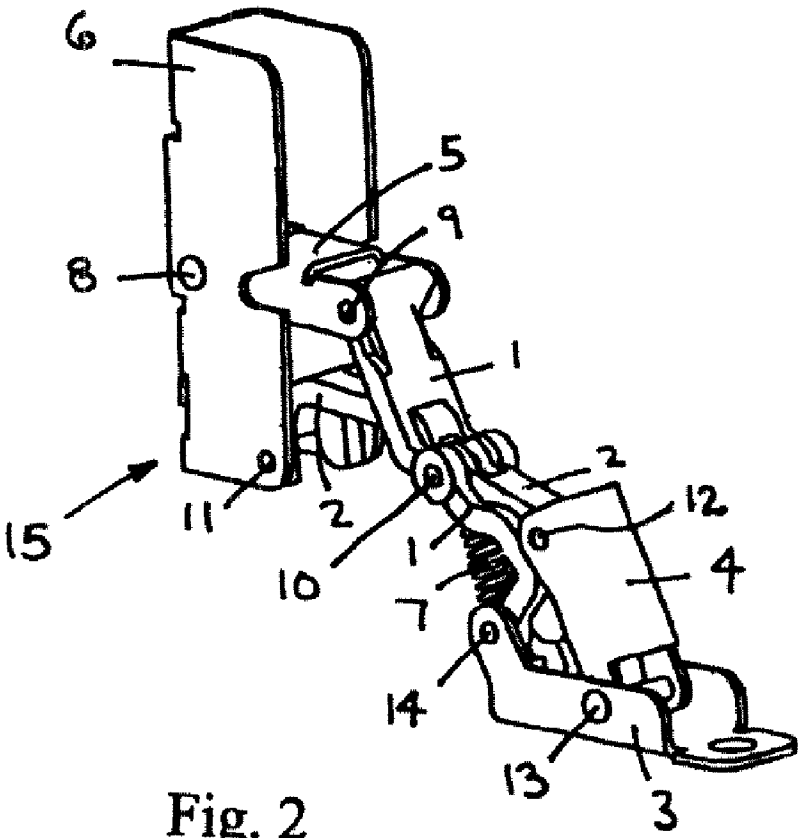
FIG. 2 is a perspective view of the hinge of FIG. 1 in an open position.
Figure 1:
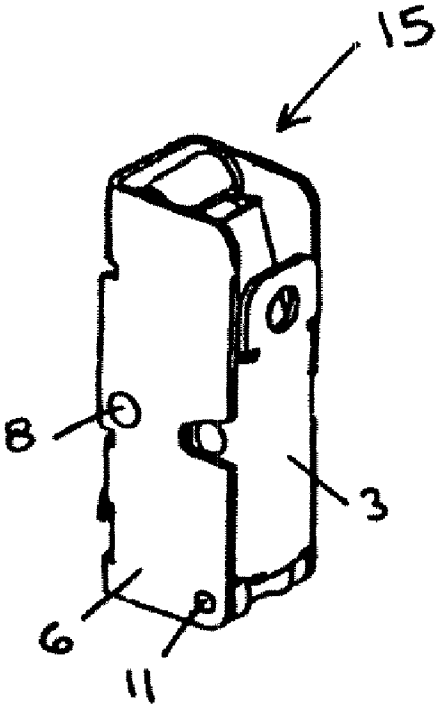
FIG. 1 is a perspective view of the assembled hinge of the present invention in the closed position.

As seen in FIG. 2, the hinge 15 has an elongate first member 1 and an elongate second member 2 which move relative to one another in the plane of their elongations thereby pivoting in a scissor-like operation about central pivot means 10. A spring 7 attached at one end to the central pivot means 10 biases the first member 1 relative to a support member 3 which is in turn pivotable at pivot support means 14 relative to an end of the first member 1. A link member 4 is attached to an end of the second member 2 and is pivotable at one end at first link pivot means 12. Second link pivot means 13 permits pivoting of link member 4 relative to an end of support member 3 to implement an articulated motion between the first member 1 and second member 2 as they move relative to one another.

The hinge base 6 or body has a base link member 5 pivotable around pivot means 8 on the hinge base 6 or body and the base link member 5 is pivotable at base link pivot means 9 at one end relative to an end of the first member 1. One end of the second member 2 is pivotable at second member pivot means 11 on the hinge base 6 or body.

The spring force of spring 7 is selected to match the door or panel weight, and other factors which are considered.

When the hinge is extended from the closed position to an open position or an intermediate open position, the support member 3 can support the weight of a panel (not shown) and hold it in the open position.

Figure 9:
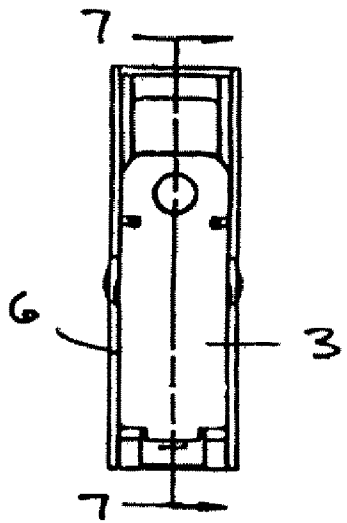
FIG. 9 is a front view of the hinge of FIG. 1 in a first intermediate opening position.
Figure 8:
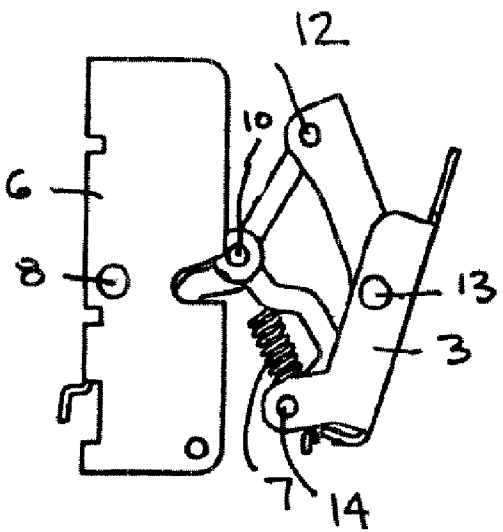
FIG. 8 is a side view of the hinge of FIG. 1 in a first intermediate opening position.
Figure 7:
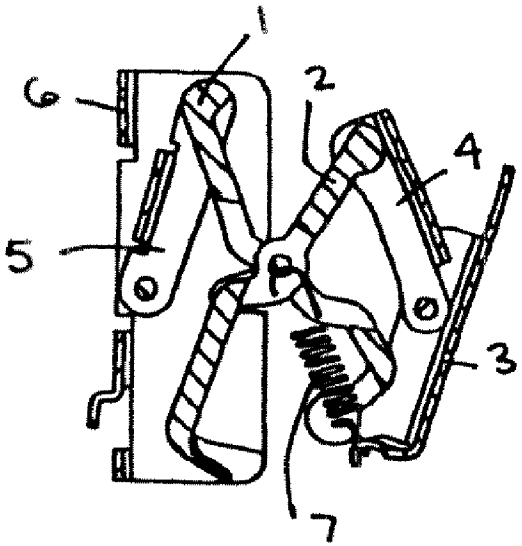
FIG. 7 is a side view of the hinge of FIG. 1 taken along line 7-7 of FIG. 9 in a first intermediate opening position.
Figure 12:
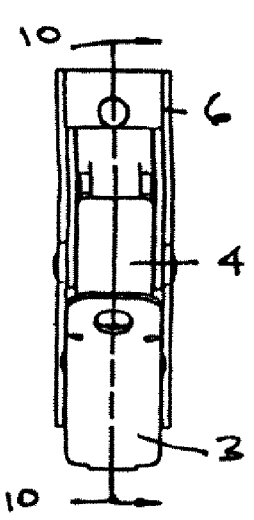
FIG. 12 is a front view of the hinge of FIG. 1 in a second intermediate opening position.
Figure 11:
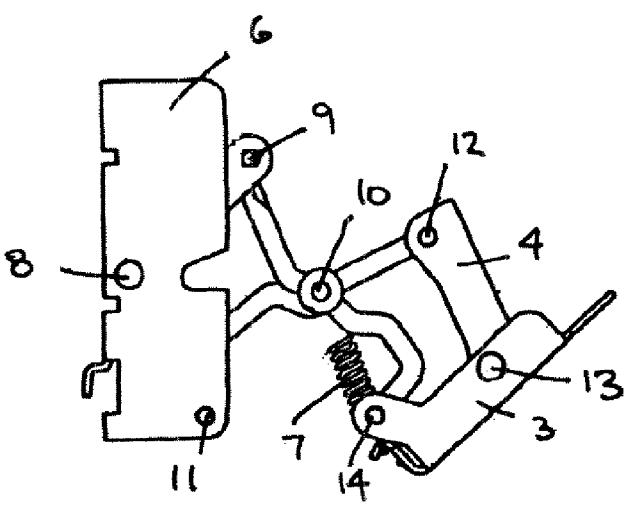
FIG. 11 is a side view of the hinge of FIG. 1 in a second intermediate opening position.
Figure 10:
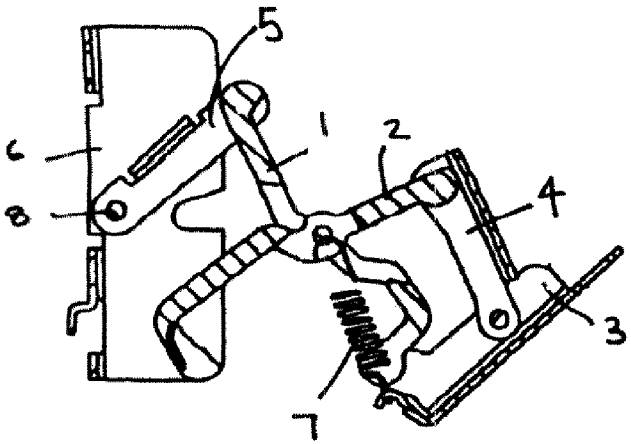
FIG. 10 is a side view of the hinge of FIG. 1 taken along line 10-10 of FIG. 12 in a second intermediate opening position.
Figure 15:
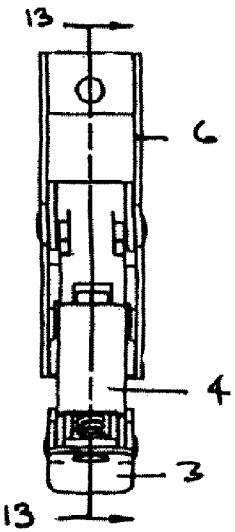
FIG. 15 is a front view of the hinge of FIG. 1 in a third intermediate opening position.
Figure 14:
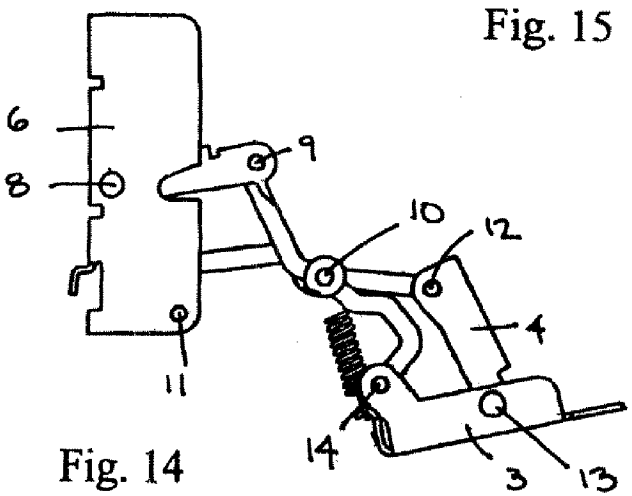
FIG. 14 is a side view of the hinge of FIG. 1 in a third intermediate opening position.
Figure 13:
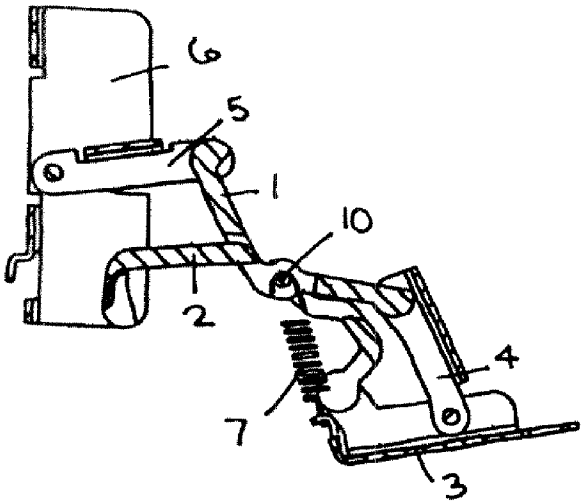
FIG. 13 is a side view of the hinge of FIG. 1 taken along line 13-13 of FIG. 15 in a third intermediate opening position.
Figure 18:
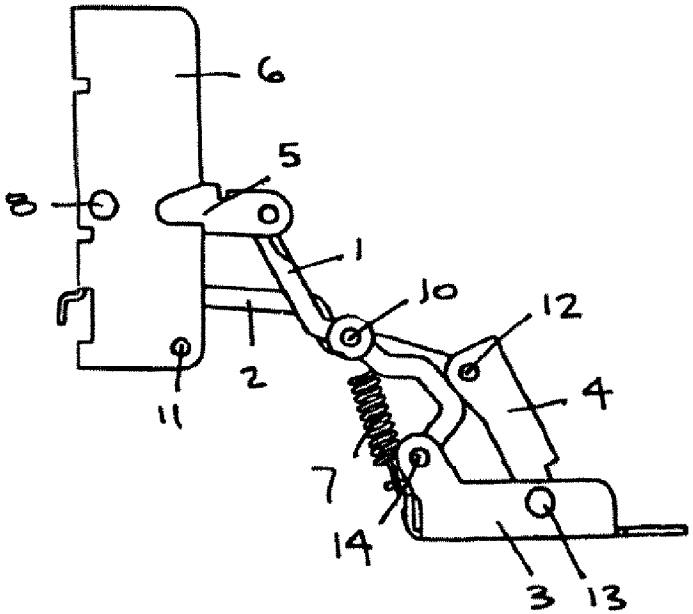
FIG. 18 is a side view of the hinge of FIG. 1 in the open position.
Figure 17:
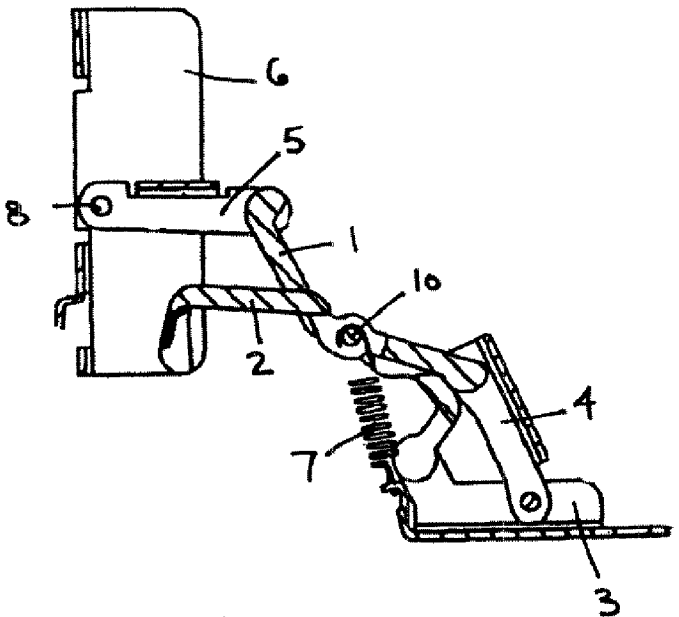
FIG. 17 is a side view of the hinge of FIG. 1 taken along line 17-17 of FIG. 16 in the open position.
Figure 16:
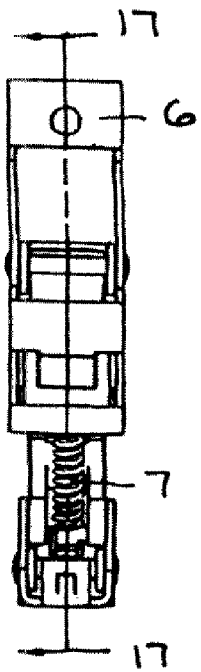
FIG. 16 is a rear view of the hinge of FIG. 1 in the open position.
Figure 20:
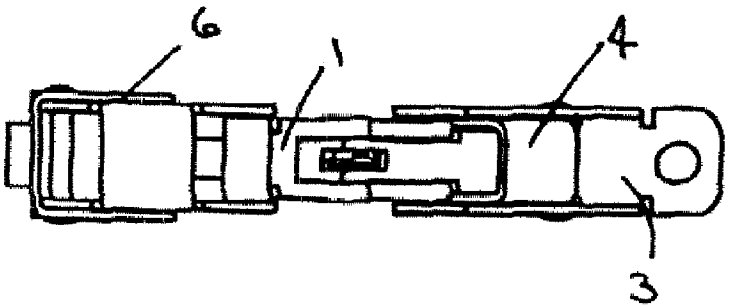
FIG. 20 is a top view of the hinge of FIG. 1 in the open position.
Figure 21:
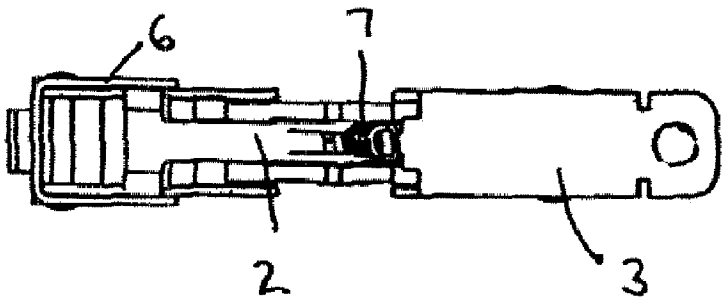
FIG. 21 is a bottom view of the hinge of FIG. 1 in the open position.
Figure 19:
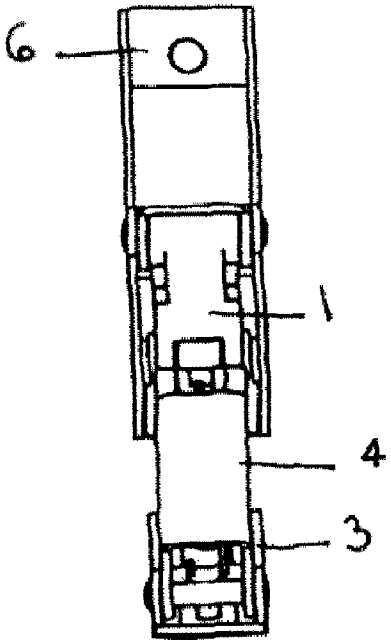
FIG. 19 is a front view of the hinge of FIG. 1 in the open position.
Figure 22:
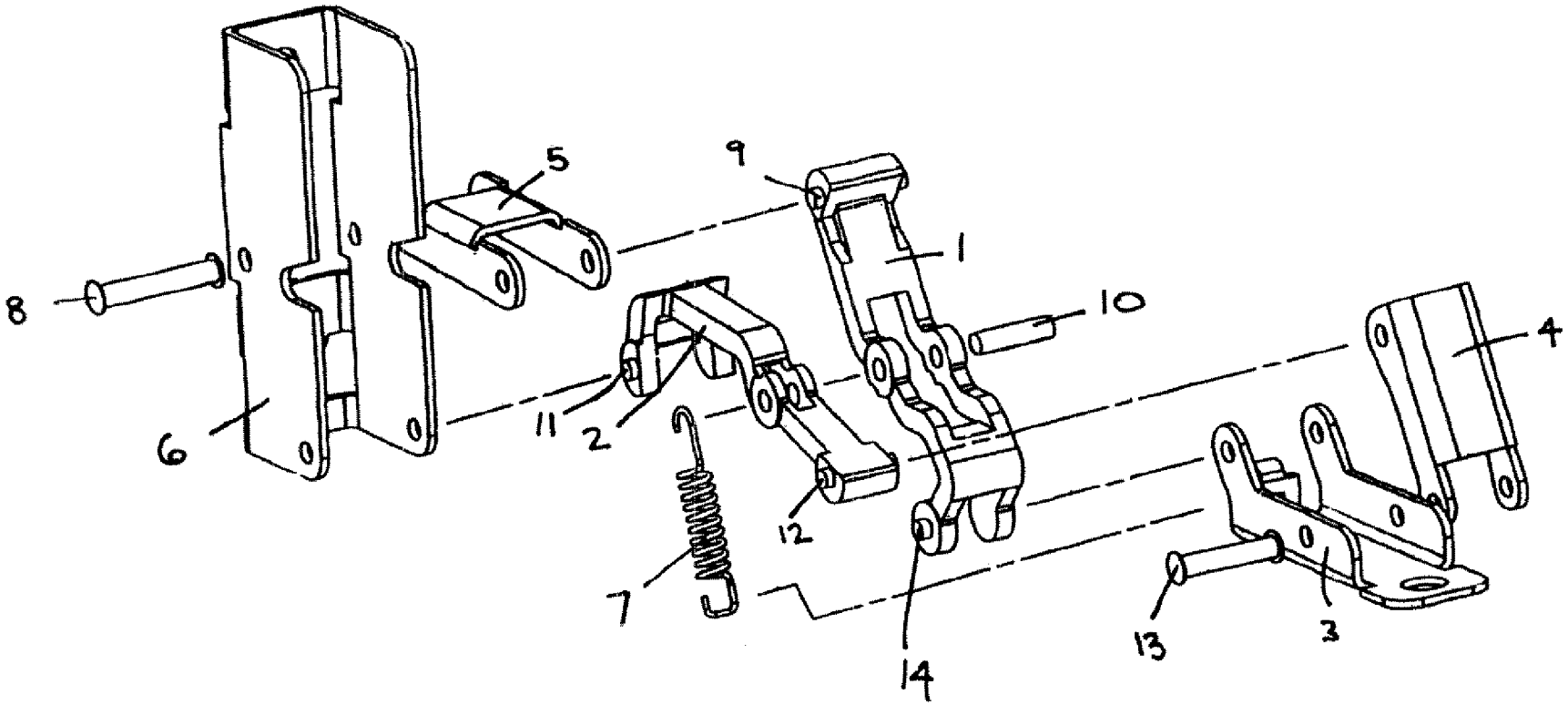
FIG. 22 is an exploded view of the hinge of FIG. 1 in an open position.
Figure 23:
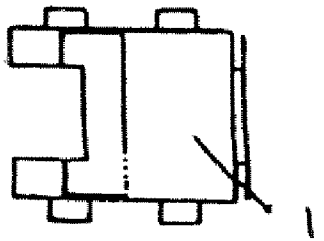
FIG. 23 is a top view of the first member of the hinge of FIG. 1.
Figure 24:
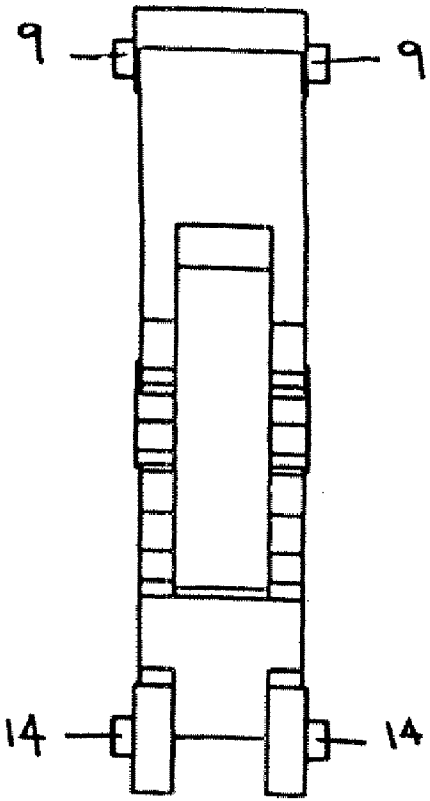
FIG. 24 is a rear view of the first member of the hinge of FIG. 1.
Figure 25:
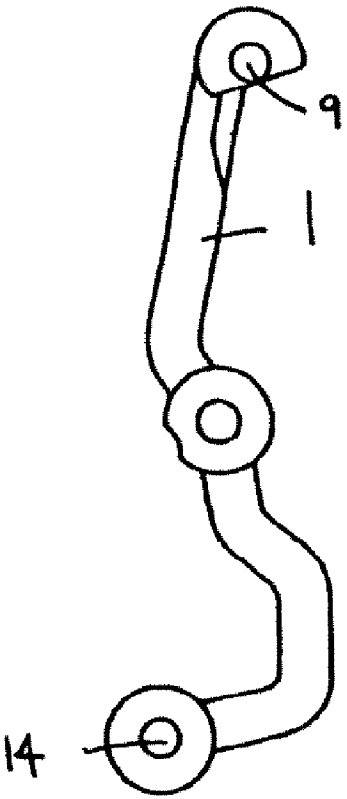
FIG. 25 is a side view of the first member of the hinge of FIG. 1.
Figure 28:
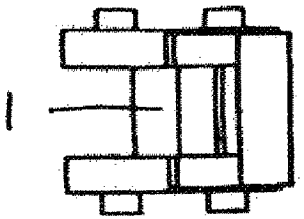
FIG. 28 is a bottom view of the first member of the hinge of FIG. 1.
Figure 27:
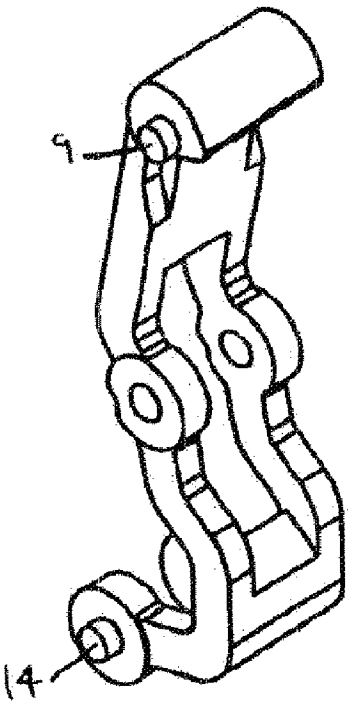
FIG. 27 is a perspective view of the first member of the hinge of FIG. 1.
Figure 26:
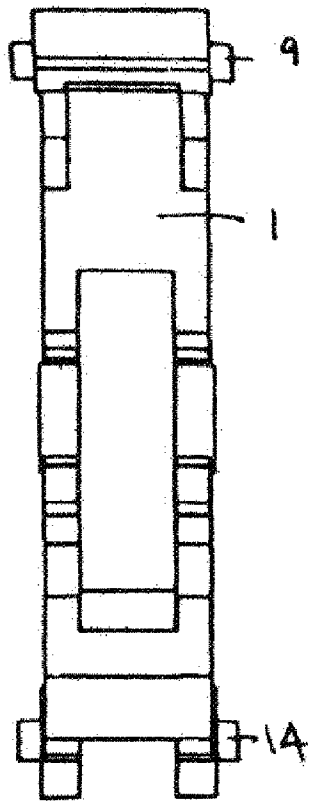
FIG. 26 is a front view of the first member of the hinge of FIG. 1.
Figure 32:
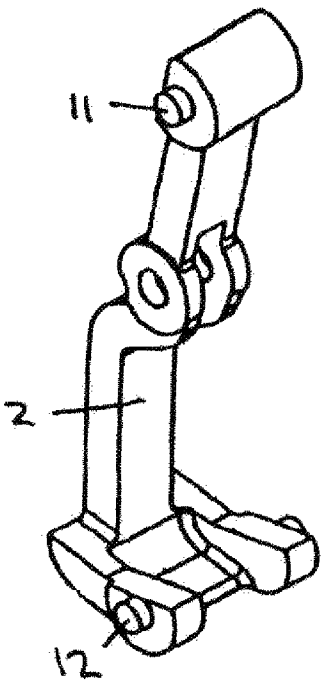
FIG. 32 is a perspective view of the second member of the hinge of FIG. 1.
Figure 31:
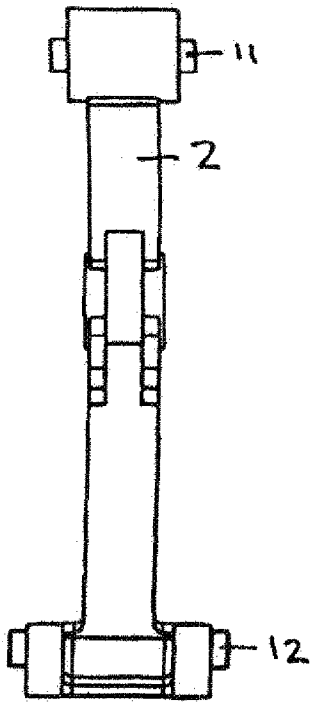
FIG. 31 is a front view of the second member of the hinge of FIG. 1.
Figure 30:
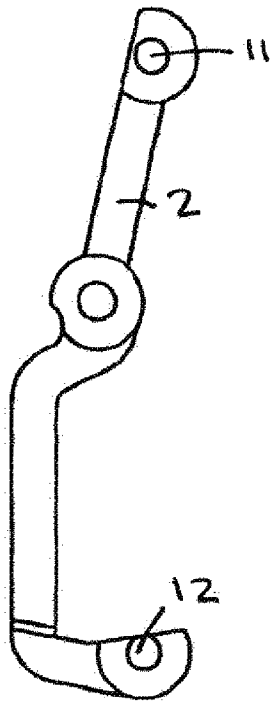
FIG. 30 is a side view of the second member of the hinge of FIG. 1.
Figure 29:
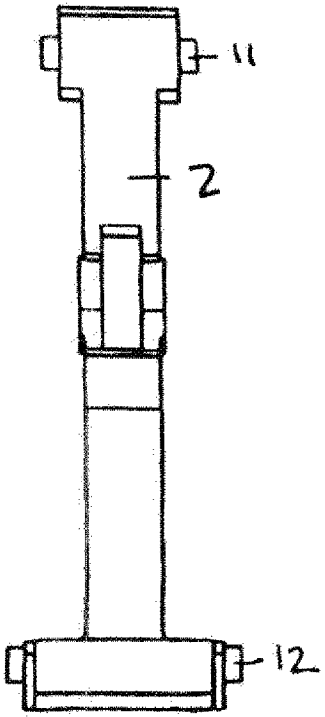
FIG. 29 is a rear view of the second member of the hinge of FIG. 1.
Figure 36:
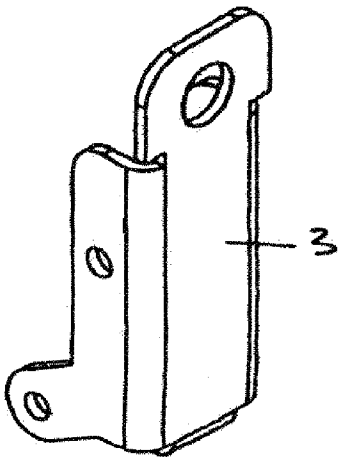
FIG. 36 is a perspective view of the support member of the hinge of FIG. 1.
Figure 35:
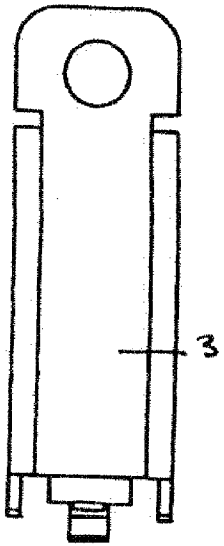
FIG. 35 is a front view of the support member of the hinge of FIG. 1.
Figure 34:
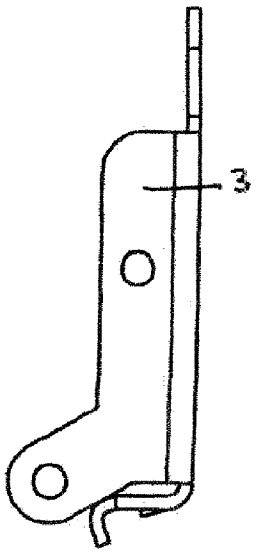
FIG. 34 is a side view of the support member of the hinge of FIG. 1.
Figure 33:
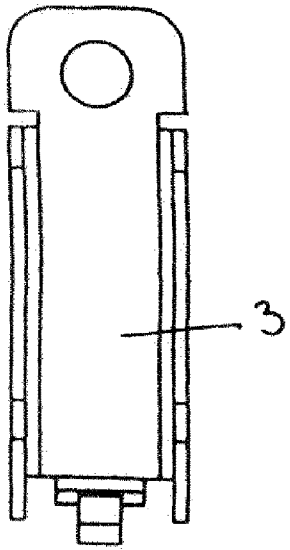
FIG. 33 is a rear view of the support member of the hinge of FIG. 1.
Figure 39:
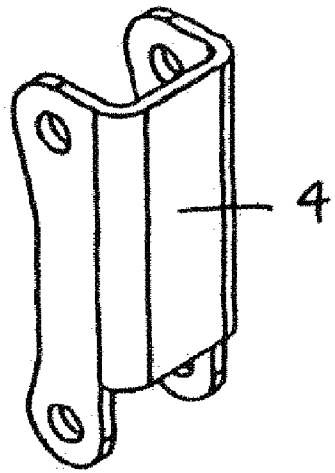
FIG. 39 is a perspective view of the support link member of the hinge of FIG. 1.
Figure 38:
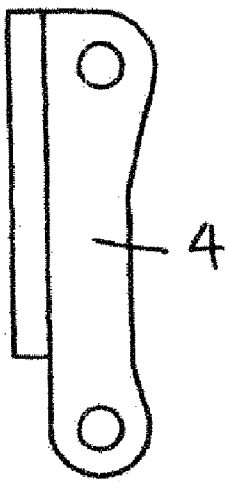
FIG. 38 is a side view of the support link member of the hinge of FIG. 1.
Figure 37:
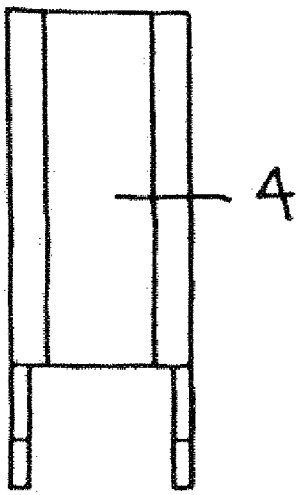
FIG. 37 is a front view of the support link member of the hinge of FIG. 1.
Figure 43:
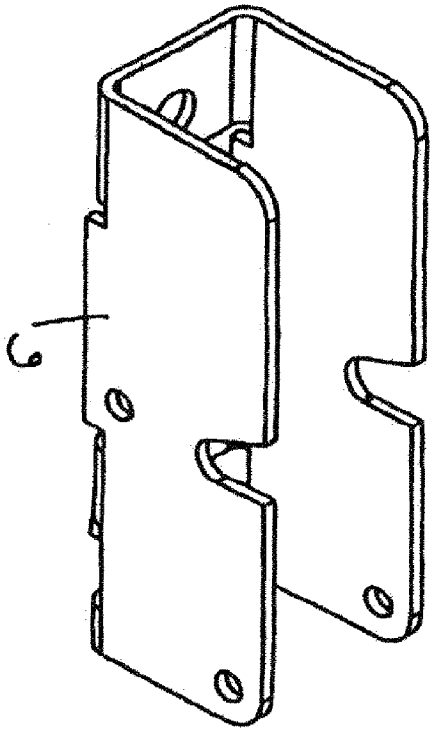
FIG. 43 is a perspective view of the base member of the hinge of FIG. 1.
Figure 42:
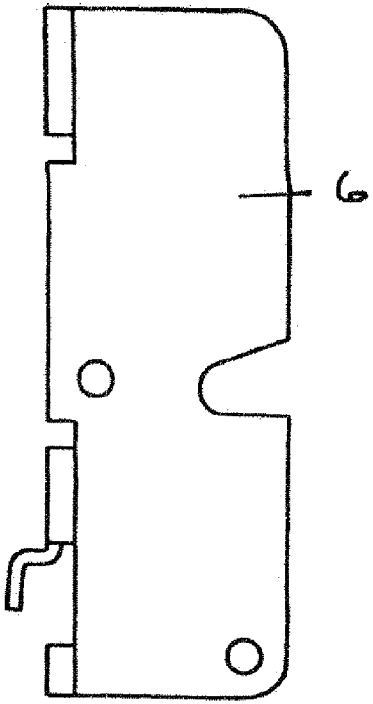
FIG. 42 is a side view of the base member of the hinge of FIG. 1.
Figure 41:
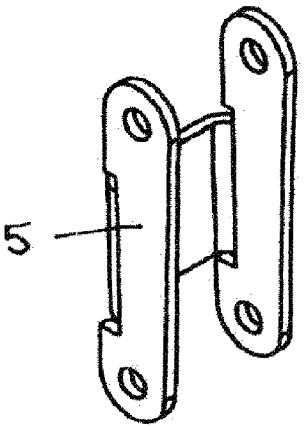
FIG. 41 is a perspective view of the base link member of the hinge of FIG. 1.
Figure 40:
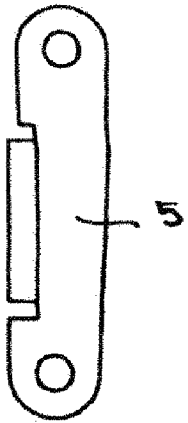
FIG. 40 is a side view of the base link member of the hinge of FIG. 1.
Figure 45:
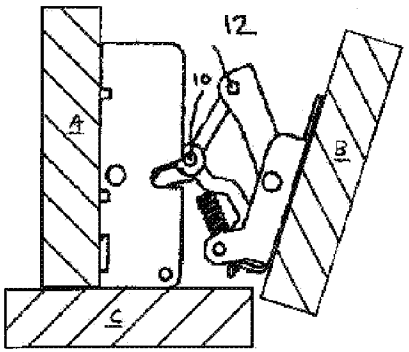
FIG. 45 is a side view of the hinge of FIG. 1 installed and in a first intermediate opening position.
Figure 47:
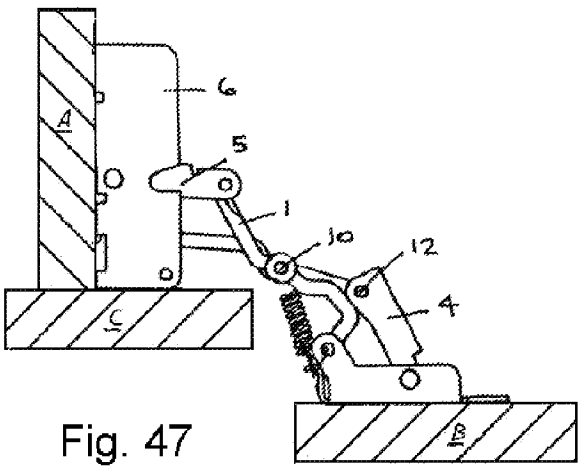
FIG. 47. is a side view of the hinge of FIG. 1 installed and in the open position.
Figure 44:
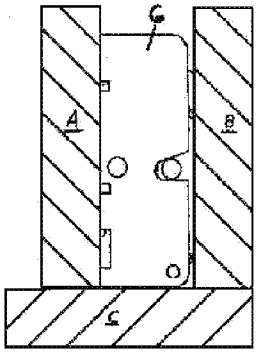
FIG. 44 is a side view of the hinge of FIG. 1 installed and in the closed position.
Figure 46:
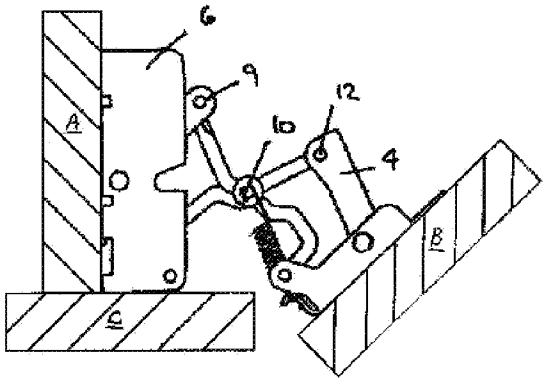
FIG. 46. is a side view of the hinge of FIG. 1 installed and in a second intermediate opening position.

Opening of the hinge is shown in FIGS. 7-9 at a first intermediate position to a second intermediate position in FIGS. 10-12 and a third intermediate position in FIGS. 13-15. FIGS. 16-18 show the hinge in the preferred frilly open position in which a panel to which the hinge is attached has been opened frilly 90 degrees. FIGS. 44 through 47 also provide detail of the claimed invention relative to three panels, panels A, B, and C, when the hinge is installed and transition from a closed to an open position. As can be seen by the location of support member 3 to which a panel can be attached, the panel has moved away from the body of the hinge, thereby avoiding contact with an object such as another panel which may be located below the opened panel.

Figure 6:
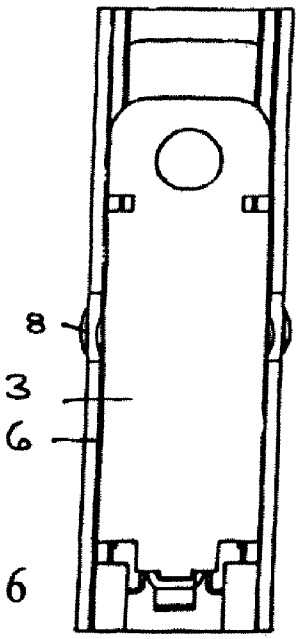
FIG. 6 is a rear view of the hinge of FIG. 1 in the closed position.
Figure 5:
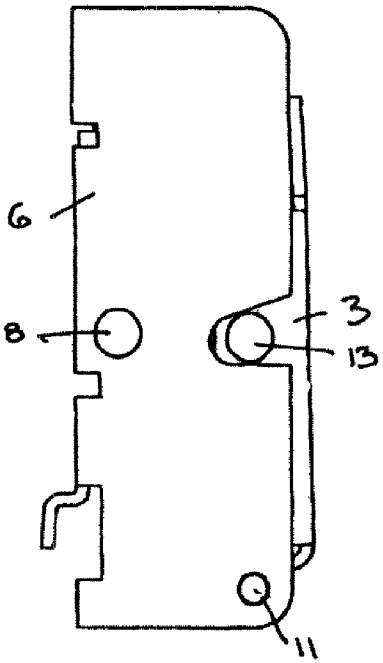
FIG. 5 is a side view of the hinge of FIG. 1 in the closed position.
Figure 4:
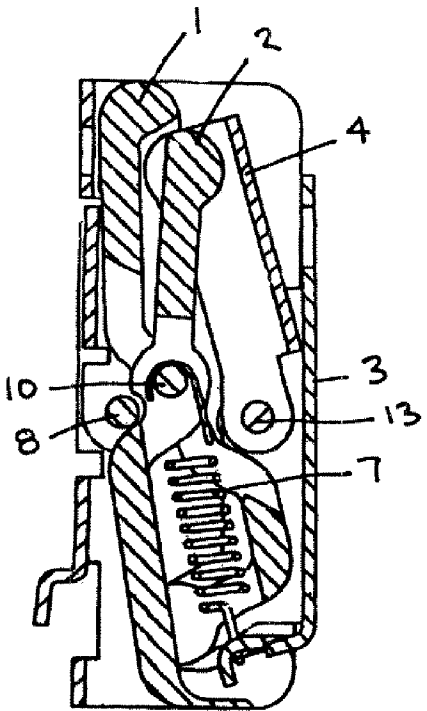
FIG. 4 is a sectional view of the hinge of FIG. 1 taken along line 4-4 of FIG. 3 in the closed position.
Figure 3:
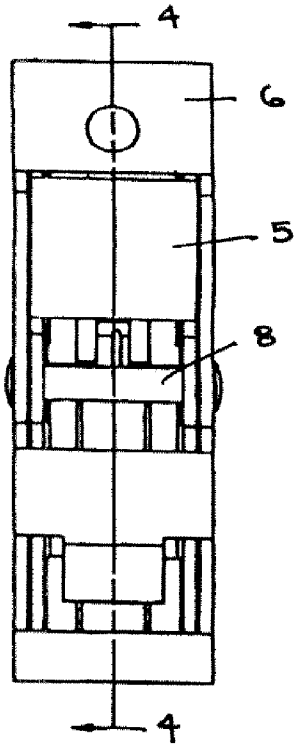
FIG. 3 is a rear view of the hinge of FIG. 1 in the closed position.

As can be seen in the exploded view shown in FIG. 6, the central pivot means 10, the second link pivot means 13, and pivot means 8 are in the form of a pin in their preferred form.

Many changes can be made in the above-described invention without departing from the intent and scope thereof. It is therefore intended that the above description be read in the illustrative sense and not in the limiting sense. Substitutions and changes can be made without departing from the scope and intent of the invention.

I claim:

1. A hinge for attaching a first panel to a second panel such that the first panel is pivotable relative to the second panel from a closed position when the hinge is contracted to an open position, the hinge comprising:

a hinge base for connecting to the second panel, the hinge base having a base link member pivotable relative to the hinge base, a support member for connecting to the first panel, a first member connected to an end of the base link member, said first member having an outer perimeter and an opening bounded by said outer perimeter, a second member connected to the hinge base, the second member being inserted through the opening in the first member, and the first member and second member being pivotable relative to one another about a central pivot means, the central pivot means being inserted through the opening in the first member perpendicular to the second member, a biasing means connected to the central pivot means and the support member for biasing the first member relative to the support member, a pivot support means about which the support member is pivotable relative to the first member, a link member connected to the second member and the support member at opposite ends of the link member, a first pivot link means about which the second member is pivotable relative to the link member, and a second pivot link means about which the support member is pivotable relative to the link member, wherein, the hinge is capable of maintaining the first panel parallel to the second panel in the closed position, and wherein said base link member, said first member, said second member, and said link member are drawn into said base member when said hinge retracts the first panel from the open position to the closed position, such that said base link member, said first member, said second member, and said link member are contained within a space defined by said base member when the first panel is in the closed position.

2. The hinge according to claim 1 wherein the biasing means is a spring.

3. The hinge according to claim 2 wherein the spring is a coil spring.

4. The hinge according to claim 1 in combination with the first panel and the second panel.

5. The hinge according to claim 1 wherein the central pivot means and the second pivot link means are pins.

6. The hinge according to claim 3 wherein the central pivot means and the second pivot link means are pins.

7. The hinge according to claim 6 wherein the base link member is connected to the hinge base with a pin.

8. The hinge according to claim 1 wherein the support member has a first end at which the support member is connected to the link member and a second end at which the first member connects to the support member.

9. The hinge according to claim 3 wherein the support member has a first end at which the support member is connected to the link member and a second end at which the first member connects to the support member.

10. The hinge according to claim 1 wherein said support member is capable of displacing said first panel relative to said hinge base between the closed position and the open position, such that the entire first panel moves away from said hinge base when transitioning from the closed position to the open position.

11. The hinge according to claim 1 wherein the support member is pivotable to a fully open position in which the first panel connected to said support member has pivoted 90 degrees from the closed position.

* * * * *